US006609995B1

(12) United States Patent
Kurz

(10) Patent No.: US 6,609,995 B1
(45) Date of Patent: Aug. 26, 2003

(54) RHYTHMIC MOTION DRIVER

(76) Inventor: Norman Kurz, 451 14th St., Brooklyn, NY (US) 11215

( * ) Notice: Subject to any disclaimer, the term of this patent is extended or adjusted under 35 U.S.C. 154(b) by 29 days.

(21) Appl. No.: 09/631,480

(22) Filed: Aug. 3, 2000

Related U.S. Application Data

(62) Division of application No. 09/338,306, filed on Jun. 22, 1999.

(51) Int. Cl.[7] ..... A63B 21/02
(52) U.S. Cl. ..... 482/121; 482/122; 482/135
(58) Field of Search ..... 482/44–46, 51–65, 482/70, 92, 93, 95, 100, 101, 121–123, 127, 129, 135–138, 148

(56) References Cited

U.S. PATENT DOCUMENTS 2,920,418 A * 1/1960 Britt ..... 446/241
5,039,091 A * 8/1991 Johnson ..... 272/131
5,242,351 A * 9/1993 Berg et al. ..... 482/110
5,509,878 A * 4/1996 Denega et al. ..... 482/110
5,857,941 A * 1/1999 Maresh et al. ..... 482/51
6,340,340 B1 * 1/2002 Stearns et al. ..... 482/52

* cited by examiner

*Primary Examiner*—Nicholas D. Lucchesi
*Assistant Examiner*—Tam Nguyen
(74) *Attorney, Agent, or Firm*—Gibbons, Del Deo, Dolan, Griffinger & Vecchione

(57) ABSTRACT

A rhythmic motion driver having a case containing flywheels and a guide along which the flywheels move linearly while rotating. A spring is within the case that compresses and expands in response to oscillatory motion of a bar that extends through an opening in the case. The spring compression and expansion is slowed but not dampened by the movement of the flywheels.

17 Claims, 6 Drawing Sheets

RHYTHMIC MOTION DRIVER

This application is a division of application Ser. No. 09/338,306 filed Jun. 22, 1999.

BACKGROUND OF THE INVENTION

1. Field of the Invention

The invention relates broadly to exercise machines.

2. Discussion of Related Art

In the field relating to sport training devices and exercise machines, the prior art is, with few exceptions, devoted to machines in which the user moves continually or repeatedly against a resisting force. But the prior art overlooks the significant advantages of combining basic mechanical technologies in a way that allows a machine to translate the exertions of the user into a controlled rhythmic motion that in turn has sufficient momentum, independently of the user's body weight, to act back upon the user, coaxing him to assume the rhythmic pattern of motion produced by the machine.

The current invention, a rhythmic motion driver, is intended to be a basic machine unit, able to be easily employed in a large variety of ways. The invention makes possible a new method of machine-assisted exercise and recreational body movement, based upon inducing a user to maintain a rhythm with his hands, feet, or body. As an alternative to working only against a resisting force, as in most currently existing machines in this field, it becomes possible with the invention to work in resonance with a rhythmic motion.

Currently existing user-powered exercise machines tend to stop, or return to an initial position and stop, at the moment a user ceases his exertions, because the motion of the machine is resisted. Indeed, much attention in the prior art has understandably been focused upon providing a suitable means of resistance to the force exerted by the user. The work expended by the user of the machines in this field, is expended in overcoming such resistance, whether by lifting a weight, compressing or extending a spring, bending a flexible rod, turning a flywheel against a restraining force, or by moving against a pneumatic, hydraulic or electromagnetic resistance device, and it is this work that provides the essential benefit of these machines to the user, such as muscle building or aerobic training.

However, continually working against a resisting force produces an experience that is inherently motivational only for a few; it is an experience of work only, and much of the motivation is usually not the experience itself, but the desire for the perceived benefit. Whereas, a more a playful movement, such as a movement to the rhythm of dance, for example, is inherently motivational for many. Despite the fact that there is work being done, the body experiences pleasure in "going with" a movement that seems, in turn, to carry it along. The rhythmic method of machine exercise, which does in fact carry the body along to some degree in a rhythmic pattern has, therefore, a distinct motivational advantage over the all-work experience of action against a resisting force. And because the exercise experience itself is more pleasurable, the rhythmic method of machine exercise is less likely than existing machines to be abandoned by the user when the novelty of it has worn off, and is therefore likely to contribute significantly to the commercial market and to the total amount of machine exercise actually being done.

BRIEF SUMMARY OF THE INVENTION

The rhythmic motion driver is a self-contained unit with the rhythmic action immediately utilizable by attaching a handle, pedal or moving structural component, to an attachment bar of the driver. This self-contained characteristic of the driver offers further considerable advantages over machines built with an elaborate specific configuration for a particular type of exercise, because employing the driver in various ways makes possible the simple construction of a wide range of exercisers. The driver, with attached handle, can be secured to a wall or doorway, for example, for use in its simplest form. In more complex forms, a suitable frame can be designed to secure the driver, or a number of drivers, in a particular position that puts the rhythmic motion along any desired path. Simple adjustable but stationary mountings on a frame, allowing the rhythmic motion driver unit to be adjusted as to position and angle, make possible custom machine configurations without re-designing the structural elements of a machine.

Further, by having a frame hold in position separate rhythmic motion drivers, each hand of a user, for example, can be compelled into a rhythmic motion independently of the other hand. A new element of machine versatility is automatically introduced by such a configuration, because a user can change the exercise being performed simply by exerting a greater effort in resonance with, or in resistance to, the rhythmic motion of one hand than he does in regard to the motion of the other hand. Acting to enhance or resist the rhythmic motion will slowly change the rhythm of the driver. The user can, for example, move gradually and seamlessly from a rhythmic pattern wherein the motions of the two hands move exactly opposite to each other, to a pattern where the two hands are moving back and forth together. A simple arrangement of multiple rhythmic motion drivers can therefore introduce significant elements of variety and change, as well as challenges of coordination, into the exercises performed.

But most notable perhaps of all the unique features of rhythmic motion machine exercise, is that more than one rhythmic motion driver can be joined together, such a combination imparting to one pedal, for instance, two independent rhythmic motions perpendicular to each other simultaneously. The result of such an arrangement is that the path of the pedal can assume a number of shapes in a single plane, such as circular or a generally elliptical figure, or, if the period of the motion in one direction is about twice as fast as in the other direction, even a figure eight pattern. In the most usual case, with a generally elliptical shape of the pedal path, appropriate exertions can cause the axes of the elliptical figure to rotate, so that the path will change gradually from an ellipse elongated horizontally to an ellipse elongated vertically and so forth. In this way, all points within a defined area of a plane are possible positions of such a pedal as it moves along one path or another, in stark contrast to any existing machine.

Many combinations are made possible by the independence of multiple rhythmic motions, but a further notable arrangement can be accomplished by joining to the two perpendicular rhythmic motions mentioned above, a third independent rhythmic motion perpendicular to each of the other two. Such an arrangement can be used to incorporate the third physical dimension into the path of a handle, for instance, so that the handle makes generally oscillating helical paths that can be varied by the user in a way that makes all points within a defined three dimensional space possible positions of the handle as it moves along one path or another. Either the two dimensional or three dimensional configurations of independent rhythmic motion thus possible allow a freedom and variability of movement of the limbs or body that is unequalled by any existing machine.

BRIEF DESCRIPTION OF THE SEVERAL VIEWS OF THE DRAWING

FIG. 9 is a perspective view of one rhythmic motion driver of FIGS. 1–6C and two rhythmic motion drivers of FIGS. 7A–7D connected to each other in succession at their centers and shown ready for use.

DETAILED DESCRIPTION OF THE INVENTION

Figure 1A:
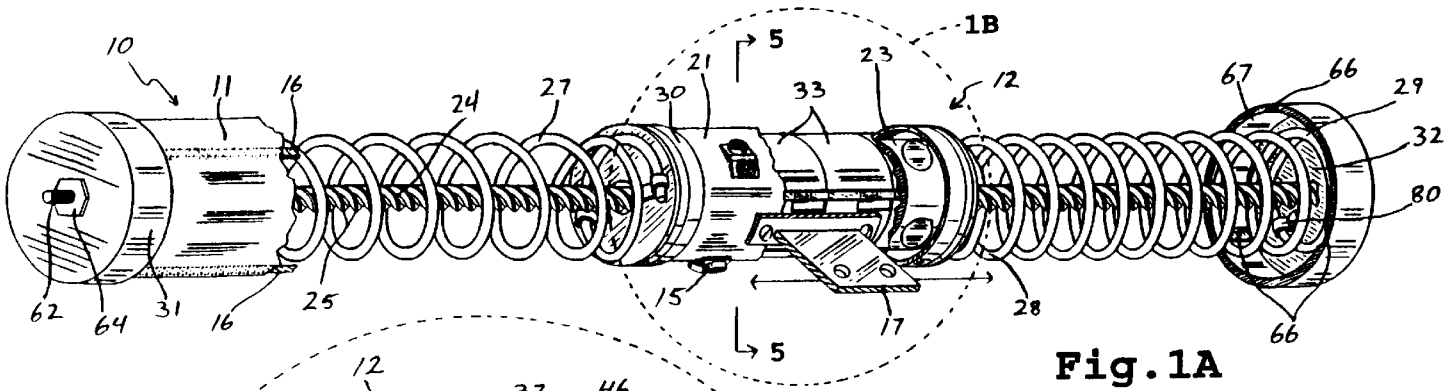
FIG. 1A is a perspective view of a rhythmic motion driver in accordance with a first embodiment.
Figure 1B:
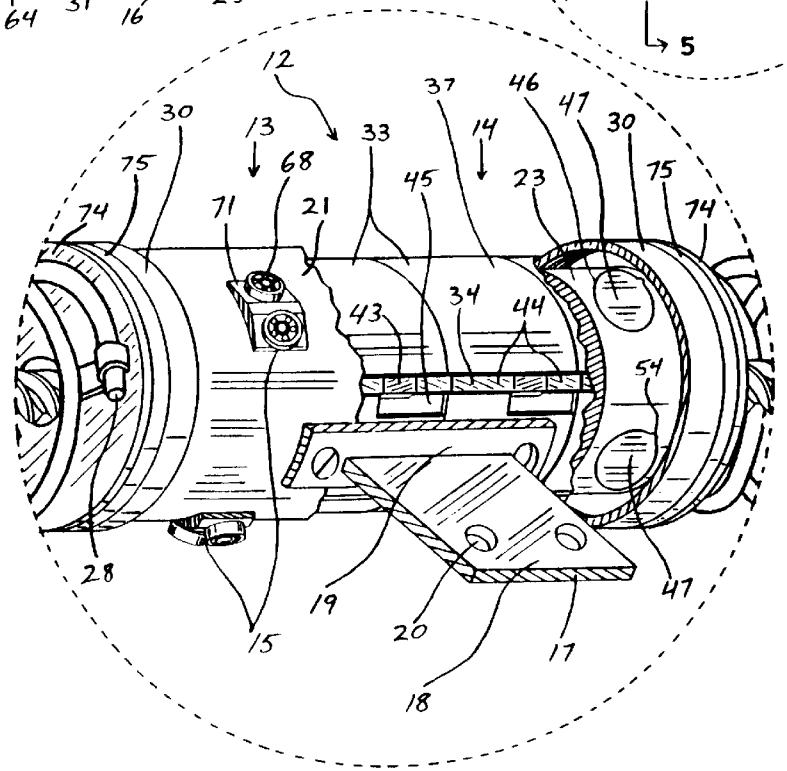
FIG. 1B is an enlarged perspective view of area 1B of FIG. 1A.
Figure 2:
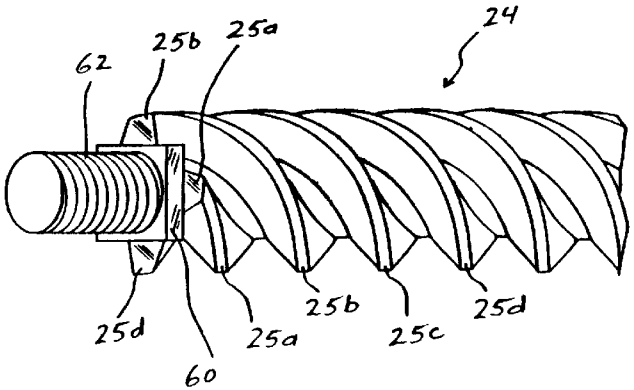
FIG. 2 is an enlarged perspective view of the center rod with helical tracks as seen in FIG. 1A but with the tubular outer housing removed.
Figure 3:
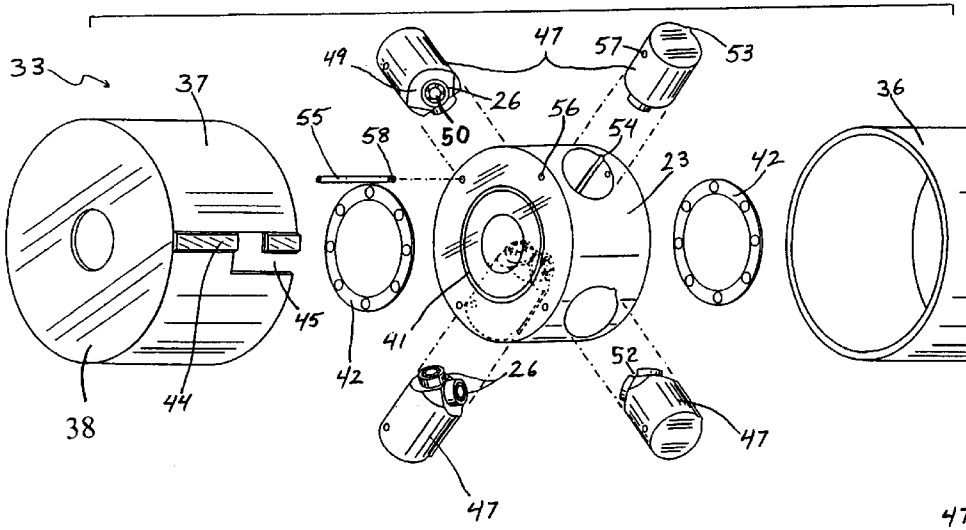
FIG. 3 is an exploded perspective view of the flywheel of FIG. 1B.
Figure 5:
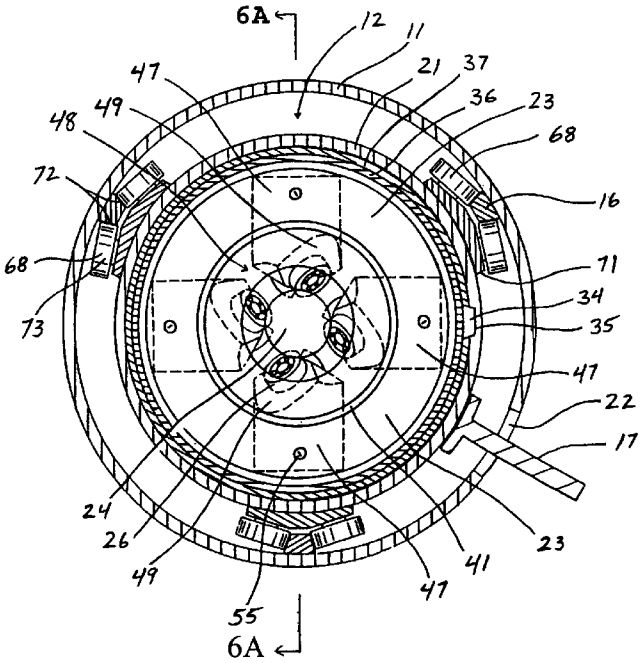
FIG. 5 is a cross-section across 5—5 of FIG. 1.
Figure 4:
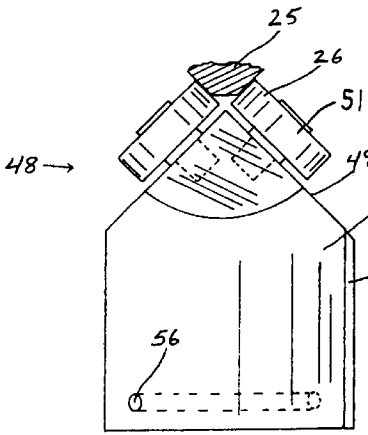
FIG. 4 is a front view of an engagement cylinder of FIG. 3.
Figure 6A:
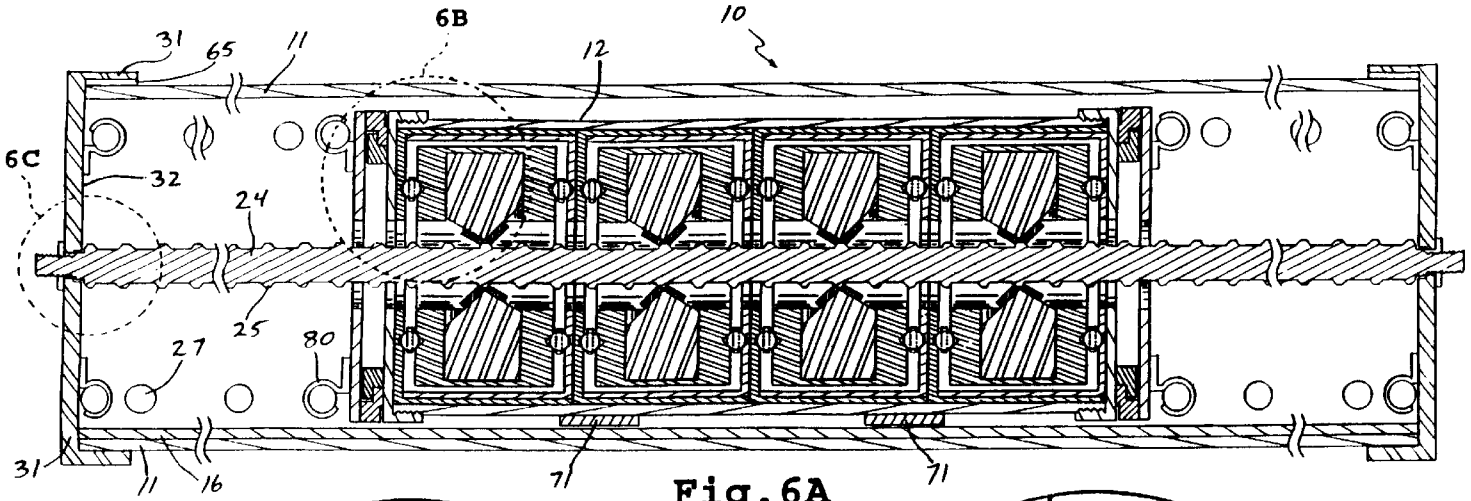
FIG. 6A is a cross-section across 6A—6A of FIG. 5.
Figure 6C:
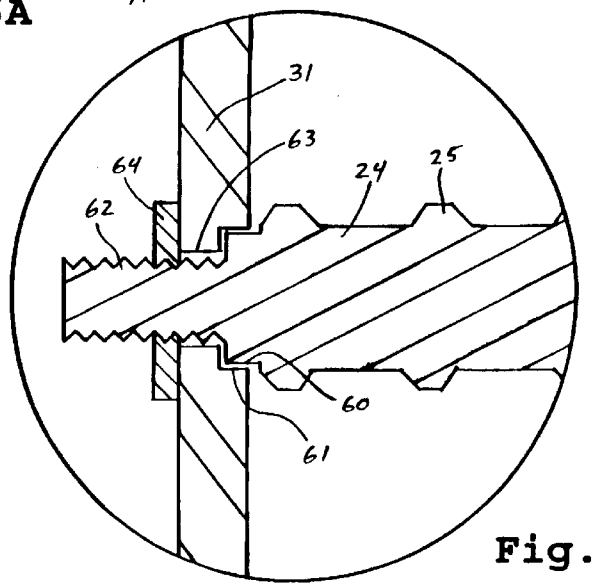
FIG. 6C is an enlarged view of area 6C of FIG. 6A.
Figure 6B:
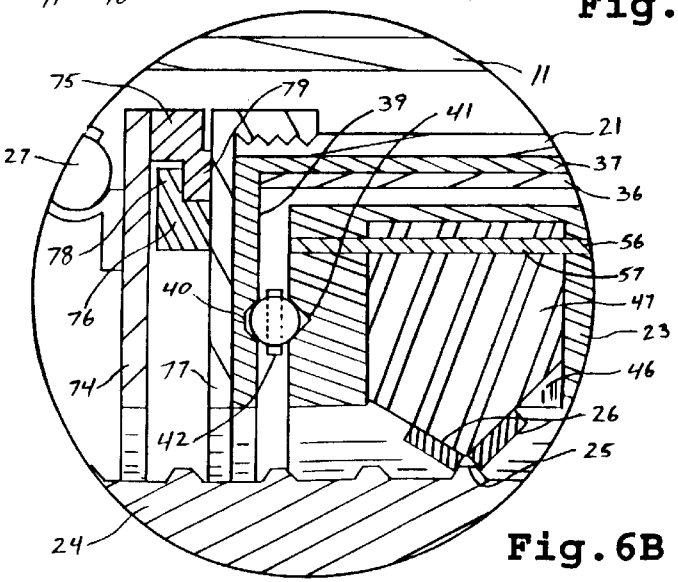
FIG. 6B is an enlarged view of area 6B of FIG. 6A.
Figures 7A, 7B, 7C, 7D:
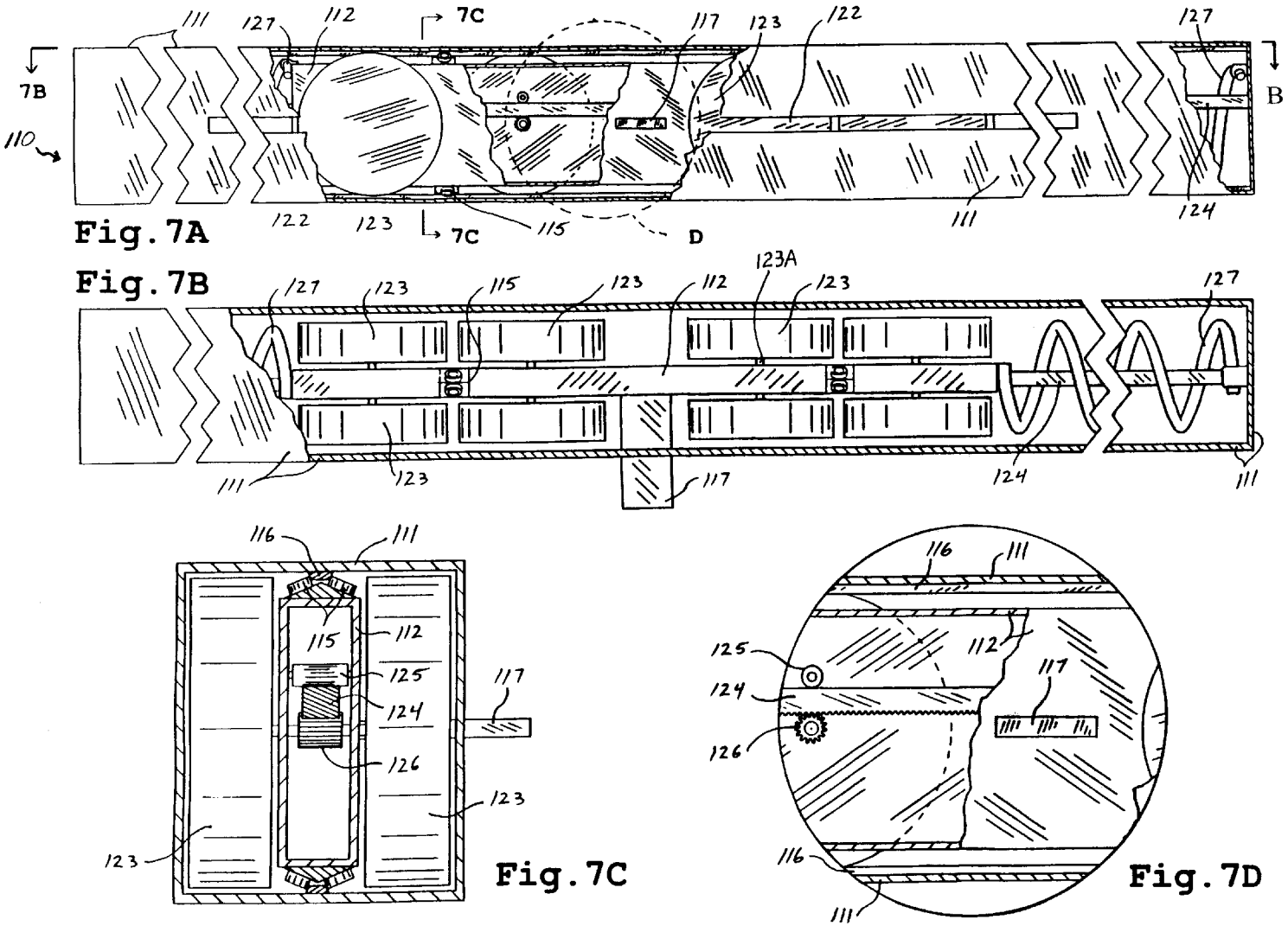
FIG. 7A is a partially broken longitudinal view of a rhythmic motion driver in accordance with a second embodiment.
FIG. 7B is a cross-section across 7B—7B of FIG. 7A.
FIG. 7C is a cross-section across 7C—7C of FIG. 7A.
FIG. 7D is an enlarged view of area 7D of FIG. 7A.

FIG. 1 shows the rhythmic motion driver 10 that includes a first member that is a securable framework of the invention. In the preferred embodiment, a tubular outer housing 11 may be clamped or otherwise secured to a stationary object to hold the rhythmic motion driver 10 rigid in a desired position.

A second member of the invention is the multiple flywheel assembly 12, which is mounted with respect to the first member so that the assembly is free to move in a low-friction guided linear path, in either direction. Any suitable guiding means producing only a low-friction linear movement of the assembly 12 with respect to the framework may be used.

In this embodiment the guiding means consists of three pairs 15 of assembly guide bearings mounted at evenly spaced intervals around a first end 13 of the multiple flywheel assembly 12 and three assembly guide bearing pairs 15 mounted around a second end 14 of the multiple flywheel assembly. The pairs of bearings ride upon three linear tracks 16 along the interior length of the driver outer housing 11. Consequently, the assembly 12 is free to move like a smaller cylinder within and along the length of the cylindrical or tubular driver outer housing 11.

The multiple flywheel assembly 12 includes an attachment mounting, or attachment bar 17, to which an object, such as a pedal, may be fastened by standard attachment means by being mounted rigidly on a multiple flywheel assembly housing 21. Standard attachment means is exemplified by using two holes 20 in the bar 17 to which an object can be bolted at a first end 18 of the bar, while a second end 19 of the attachment bar 17 is attached to the multiple flywheel assembly 12. A force applied to a handle, for example, that is attached to the attachment bar 17, will apply a force to the multiple flywheel assembly 12. The attachment bar 17 extends from the multiple flywheel assembly housing 21 out through a slot 22 in the driver outer housing, So that an object is connected to the assembly by being attached to the attachment bar 17 outside the driver housing 11.

The multiple flywheel assembly 12 is basically a cage to hold an angular momentum storage means, or set of flywheels 23, in position and rotatably mounted. The assembly 12 is subject to being forced along a center rod 24 passing through the flywheel's hollow core. The center rod in this embodiment has four helical tracks 25 coiling along its surface which engage bearings 26 around the inner core of the flywheels, causing the flywheels to spin as the flywheel assembly is forced along its linear path. The center rod 24, the helical tracks 25 and the engagement bearings 26, form an engagement means disposed between the driver outer housing 11 and the flywheels 23.

The effect of such arrangement is to make the multiple flywheel assembly 12, which is a relatively light object, easily lifted in one hand, behave, in terms of inertia and momentum, as though it had many times more mass than it actually has. Its linear movement is always accompanied by a corresponding angular momentum in the flywheels 23. In other words, a large force must be applied to the assembly 12 to move it significantly along the linear guide tracks 16, and once it is moving, a similarly large force must be applied to stop it. opposing such linear movement of the multiple flywheel assembly 12 are springs 27, attached by appropriate means to assembly housing end caps 30 at a first end 28 of the spring, and to an interior back plate 32 of the outer housing end caps 31 at a second end 29 of the spring. The springs 27 tend always to return the multiple flywheel assembly to a center position, resulting in an oscillating system producing slow periodic motion with the momentum of a heavy object. A frequency of the oscillating system in the approximate range of ½ to 2 cycles per second is contemplated for most uses of the driver as a component of an exercise machine. The frequency of the assembly oscillation can be varied by varying a number of factors, including the mass and number of flywheels used, the number of turns of the helical tracks upon the center rod per unit of linear movement, and the strength of the springs.

In greater detail, the multiple flywheel assembly 12 includes the tubular assembly housing 21, closed at either end by two assembly housing end caps 30. Individual flywheel units 33 of just small enough diameter slide smoothly and securely into the assembly housing 21. Each individual flywheel unit 33 has a flange 34 across its rim that slides into a groove 35 along the interior length of the assembly housing 21, keeping the flywheel units 33 from rotating within the assembly housing 21. The assembly housing end caps 30 are attached immovably to the assembly housing by being screwed on to the housing at each housing end, putting pressure on the individual flywheel units to help keep them immoveable within the assembly housing 21.

The individual flywheel unit 33 includes, in this embodiment, an inner cylindrical section and an outer cylindrical section. The inner cylindrical section or inner casing 36, which is smaller in diameter than the outer cylindrical section, fits into the outer cylindrical section or outer casing 37. Each cylindrical section is closed at its outer end by a side plate 38. The side plates 38 provide two flat, parallel, interior surfaces 39 inside the casing for the rotational bearing means to rotatably mount the flywheels 23. The bearing means in this embodiment includes a circular groove 40 on each interior surface 39 of the side plates 38, which groove matches in diameter and placement a circular groove 41 on each flat surface of the flywheel's disk. By such arrangement, the flywheel 23 may be sandwiched between two rings of ball bearings 42. The balls of each such ring ride in both the circular groove 41 on the flywheel's disk on one side, and in the circular groove 40 on the casing side plates 38 on the other side. Such bearing means allows the flywheels to be rotatably mounted while the inner core of the flywheel can remain hollow to let the center rod 24 pass through it.

The inner casing 36 of an individual flywheel unit 33 may be inserted into the outer casing 37 and then rotated until the flange section 43 on the inner casing is locked in as the middle section in line with the flange sections 44 on the outer casing, forming a single flange 34 which slides into the linear groove 35 along the interior cylindrical wall of the assembly housing. Such an arrangement holds the inner casing 36 and the outer casing 37 of the individual flywheel units together, while keeping the individual flywheel units from rotating within the assembly housing 21.

A slot 45 in the outer casing 37 allows the inner casing flange section 43 to slide through the outer casing when the inner casing is first inserted into the outer casing before being rotated.

The flywheel 23 itself has four cylinder holes 46 bored through it from four points, each 90 degrees from its neighbor, around the rim of the flywheel, through to the flywheel's hollow core. A flywheel engagement cylinder 47 fits into each of the four cylinder holes 46, so that core ends 48 of the flywheel engagement cylinders 47 impinge on the center rod 24 from four directions.

The engagement cylinder 47 is cut at the core end 48 into two equal faces 49 along planes intersecting at approximately at right angles. Upon these faces two flywheel engagement bearings 26 are mounted by bolting or otherwise securing a bearing inner ring 50 to the cylinder face 49. In this manner, the freely turning weight bearing outer rims 51 of the bearings form a V-shaped end 52 to the engagement cylinder 47.

When the flywheel 23 is in a position along the center rod 24 so that one of the four helical tracks 25 along the center rod is directly in the center of each cylinder hole 46 at the core of the flywheel, the engagement cylinders 47 fit fully inserted into the cylinder holes 46 at the appropriate angle of rotation so that each V-shaped cylinder end 52 rests upon both sides of the helical track 25, and the engagement bearings 26 roll upon the helical tracks as the flywheel 23 spins. Each of the four helical tracks 25 along the center rod 24 is aligned with one of the four engagement cylinders 47 of the flywheel 23. A force on the multiple flywheel assembly 12 in one direction forces the engagement bearings to bear down upon, and roll along one side of each of the tracks, making the flywheels spin in one direction, and a force in the opposite direction upon the flywheel assembly forces the bearings to bear down upon, and roll along the other side of the tracks making the flywheel spin in the opposite direction.

The four engagement cylinders 47 are each provided with a linear engagement cylinder flange 53 along its outer length. The cylinder flange 53 fits into a linear groove 5 along the interior length of the cylinder hole 46 to keep the engagement cylinders 47 in the proper rotational alignment. To keep the engagement cylinders 47 locked in a fully inserted position into the flywheel, four lock pins 55 are inserted into cylindrical lock pin holes 57 in the flywheel 23, perpendicular to the flywheel's plane of rotation. They pass through appropriately placed holes 57 in the engagement cylinders, corresponding to a fully inserted cylinder. The lock pins 55 have a threaded end 58 which tightens into a threaded end section 59 of the cylinder lock pin hole 56.

The center rod 24 is securely and immovably attached to the driver outer housing end caps 31 by fastening means appropriate to resist a force in any direction, especially along its length as well as any rotational force. The fastening means comprises, in this embodiment, a square nut-like section 60 near the end of the rod, such section 60 fitting into in a square depression 61 in the interior flat surface 32 of the outer housing end caps, thus resisting rotational movement. The extreme end sections 62 of the center rod 24 are cylindrical and threaded, allowing them to fit through a round hole 63 in the end cap 31 and be tightened against the end caps with a nut 64. The outer housing end caps 31 are in turn held from any rotational movement by three short outer housing flanges 65 running parallel to the center rod, each flange 65 being equidistant from its neighbors. The flanges 65 are around the cylindrical outer surface of the driver outer housing 11 at the ends of the housing. The outer housing flanges 65 slide into corresponding end cap grooves 66 on the interior cylindrical surface 67 of the outer housing end caps 31.

The center rod 24, with the helical tracks 25 upon its surface, is thus rigidly attached to the driver outer housing through the outer housing end caps. The center rod 24, the helical tracks 25, and the flywheel engagement bearings 26 at the core of the flywheels, constitutes the flywheel engagement means in this embodiment of the invention.

The six preferred components of the rhythmic motion driver are therefore clear: first, the framework or driver outer housing 11, second, the moveable assembly 12 having an attachment mounting, third, the set of flywheels 23, fourth, the engagement means for the flywheels, fifth, the spring and sixth, the guiding means for the assembly, including in this preferred embodiment several parts as follows.

The guiding means for the multiple flywheel assembly 12 includes three linear tracks 16 mounted at 120 degree intervals around the interior cylindrical wall of the outer housing. Each track extends along the length of the outer, housing. The three pairs of bearings 15 mounted around each end of the multiple flywheel assembly 12, upon the assembly housing 21, ride upon the three linear tracks 16. The assembly guiding bearing pairs 15 are arranged and mounted in a similar way to the engagement bearings at the ends of the flywheel engagement cylinders; that is, each guide bearing 68 of the guide bearing pair 15 is bolted or otherwise secured by its inner ring 69 to one of two faces 70 of a bearing mounting 71, leaving a space between the bearings into which the linear track 16 fits. The two faces 70 of the bearing mounting 71 are at an angle to one another and the sides of the linear track 16 are angled in a corresponding way, so that the outer rims 73 of the guide bearings 68 touch both sides of the track 16. Such an arrangement holds the guide bearings 68 on the track and prohibits any other movement but the rolling of the bearings along the track. The bearing mountings 71 are rigidly fastened to the flywheel assembly housing 21.

Additionally, the multiple flywheel assembly housing end caps 30 preferably have back plates 74 that are rotatable, to which the springs 27 are attached. Such arrangement offers two advantages. First, the natural slight twisting of the spring, as it is compressed and extended, does not exert a twisting force upon the multiple flywheel assembly, because the twisting turns only the backplates 74. Second, the rotatable back plate allows for ease of assembling the rhythmic motion driver, in that the multiple flywheel assembly 12 can be inserted into the driver outer housing 11 with the springs 27 having been attached to the flywheel assembly. The rotatable back plate allows the springs freedom to be rotated and aligned with the spring attachment means, or spring holder 80 on the interior flat back surface 32 of the outer housing end caps 26.

In this embodiment the circular rotatable back plate 74 of the assembly housing end cap 31 is rotatably mounted to the end cap by two concentric interlocking rings, an outer ring 75 and an inner ring 76. The inner ring 76 is attached rigidly to a rigid flat back plate 77 of the end cap 31, and the outer ring is attached to the rotatable back plate 74. The inner ring 76 has a lip 78 on its outer cylindrical surface, such lip extending outward. The outer ring 75 has a lip 79 on its inner cylindrical surface extending inward under lip 78 of the inner ring.

The frequency of the oscillation of the rhythmic motion driver can be adjusted in several ways. The length of the multiple flywheel assembly housing 21 can be varied to accommodate more or fewer individual flywheel units 33. The more flywheel units there are, the more angular momentum is produced with the linear movement of the assembly and therefore the slower the frequency of the oscillation Alternately, some individual units can be left empty, with no flywheel inside so that fewer engaged flywheels will produce less angular momentum and therefore a faster period to the oscillation.

Another possible adjustment is to make the helical tracks upon the center rod have more or fewer turns per unit of linear distance along the rod. Again, such adjustments will affect the amount of angular momentum produced and therefore affect the period of the oscillation.

Finally, varying the strength of the springs 27, will affect both the period of the oscillation and the amount of exertion required to maintain the oscillation, with a stronger spring producing a faster period, as well as requiring a greater exertion to move the flywheel assembly 12 back and forth.

Turning to FIGS. 7A–7D, a first alternative embodiment of the rhythmic motion driver 110 includes an extended rectangular outer housing 111 as a first member, and a multiple flywheel assembly 112, with flywheels 123 mounted so that their plane of rotation is parallel with the linear motion of the flywheel assembly 112 itself.

Such an arrangement is not quite as efficient its use of internal space as the preferred embodiment, since the flywheels cannot fill the entire rectangular space through which they sweep. The flywheels in the preferred embodiment, in contrast, sweep through the entire cylindrical space of their corresponding outerhousing. The first alternative embodiment 110 must therefore be slightly larger than the preferred embodiment to accommodate an equivalent angular momentum. Nevertheless, embodiment 110 utilizes parts that are more conventional and is therefore somewhat easier to manufacture.

The flywheels 123 are engaged by using a rack and pinion system with the center rod and helical tracks of the preferred embodiment replaced by a toothed bar 124 that engages a gear 126 mounted co-axially with, and rigidly with respect to each set of two flywheels. The toothed bar 124 extends through the multiple flywheel assembly and is attached at either end to the ends of the outer housing 111. Inside the multiple flywheel assembly the toothed bar is forced to mesh with the gear 126 by a roller 125 rotatably mounted on the assembly and pressing against the side of the bar opposite the gear, so that the toothed bar is sandwiched between the roller and the gear.

As in the preferred embodiment, the multiple flywheel assembly 112 is guided along the length of the outer housing by pairs of bearings 115 mounted on the assembly 112, which bearings ride upon linear tracks 116 attached to and running the length of the outer housing 111. Also as in the preferred embodiment, an attachment bar 117 in attached to the multiple flywheel assembly 112 and extends through a slot 122 in the outer housing.

As in the preferred embodiment, the linear motion of the multiple flywheel assembly is resisted by springs 127 attached to the multiple flywheel assembly and the ends of the outer housing.

Figure 8B:
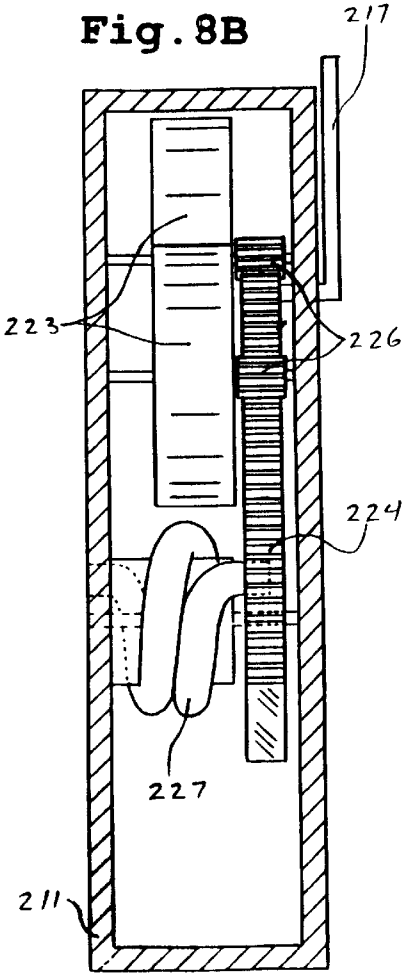
FIG. 8B is a cross-section across 8B—8B of FIG. 8A.
Figure 8A:
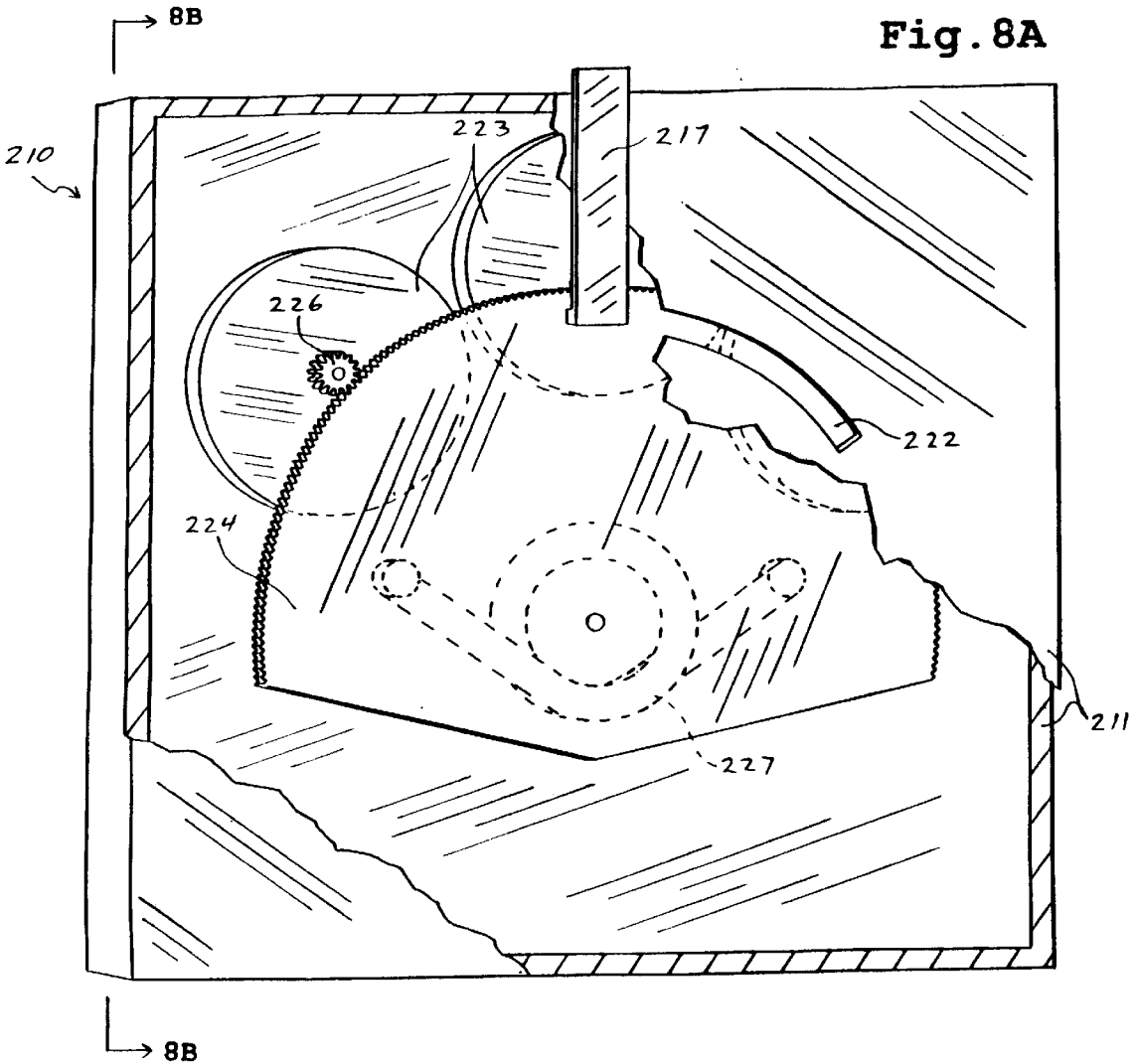
FIG. 8A is partially broken plan view of rhythmic motion driver in accordance with a third embodiment.
Figure 6:
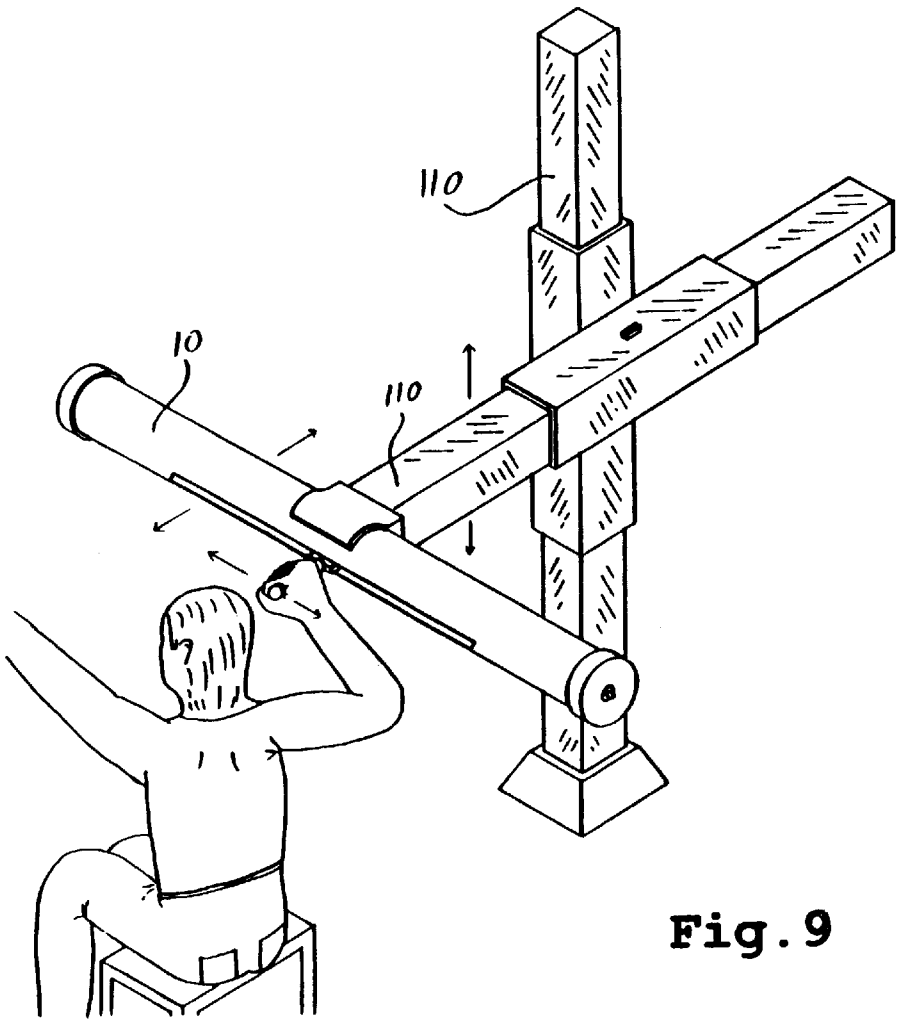

Turning to FIGS. 8A–8B, a second alternative embodiment is illustrated generally at 210, and employs a rack and pinion system to engage flywheels 223, as in the first alternative embodiment. In the second alternative embodiment the guiding means controlling the movement of one member of the rhythmic motion driver with respect to the other is a pivot, eliminating the need for the track and bearing guiding systems in the other embodiments. This embodiment must be even larger and somewhat more bulky than the first alternative embodiment, but the trade off is that fewer parts are required and therefore manufacture is even easier. An effect of using a pivot as a guiding means is that the path of an attachment bar 217 is an arcuate path.

This further embodiment of a rhythmic motion driver 210 includes flywheels 223 rotatably mounted to the outer frame 211, and gears 226 mounted rigidly and co-axially with respect to the flywheels. The gears 226 are engaged by a partial wheel 224 having a toothed edge. The wheel 224 is rotatably or pivotally mounted to the frame 211.

While it would obviously be possible to mount the flywheels 226 on the pivotable wheel 224 inside of a movable flywheel assembly, and engage them with a stationary arcuate toothed bar attached to the frame, in a fashion analogous to that in the previous embodiments, the illustrated second alternative embodiment offers a simpler configuration.

An attachment bar 217 is fixed to the pivotable wheel 224 and extends through a slot in the outer frame 211. The motion of the attachment bar 217 is therefore accompanied by simultaneous angular momentum in the flywheels 223, and is at the same time resisted by a spring 227, attached at one end to the frame 211 and at the other end to the pivotable wheel 224, creating an oscillating system as in the previous embodiments. The spring 227 in the present embodiment is resisting a smaller movement than in the previous embodiments, and is therefore considerably stronger.

FIG. 9 shows the manner in which the rhythmic motion driver 10 may be used when connected at its center to one rhythmic motion driver 110, which in turn is connected at its center to a further rhythmic motion driver 110. Each of the rhythmic motion drivers 10, 110, 110, are arranged to extend in perpendicular directions to each other, thereby being arranged in three perpendicular planes.

Thus, the user may effect movements in three different planes of movement. For instance, an elliptical oscillatory movement may be obtained in each plane.

LIST OF DESCRIPTIVE REFERENCE NUMBERS 10. a rhythmic motion driver illustrated generally
11. a driver outer housing
12. a multiple flywheel assembly
13. a first end of the multiple flywheel assembly
14. a second end of the multiple flywheel assembly
15. a pair of assembly guide bearings
16. a linear assembly guide track
17. an attachment bar
18. a first end of the attachment bar
19. a second end of the attachment bar
20. a hole in the attachment bar at the first end of the bar
21. a multiple flywheel assembly housing
22. a slot in the driver outer housing
23. a flywheel
24. a center rod
25. a helical track
26. a flywheel core engagement bearing
27. a spring
28. a first end of a spring
29. a second end of a spring
30. a multiple flywheel assembly housing end cap
31. an outer housing end dap
32. an inferior flat black surface of the outer housing end cap
33. an individual flywheel unit
34. a flywheel unit flange
35. a linear groove along the interior cylindrical wall of the assembly housing
36. a flywheel unit inner casing
37. a flywheel unit outer casing
38. a flywheel unit casing side plate
39. an interior surface of the flywheel unit casing side plate
40. a circular groove on the interior surface of the casing sideplate
41. a circular groove on a flat surface of the flywheel disk
42. a ring of ball bearings
43. a flywheel unit inner casing flange section
44. a flywheel unit outer casing flange section
45. a flywheel unit outer casing slot
46. a flywheel engagement cylinder hole
47. a flywheel engagement cylinder
48. a flywheel core end of the flywheel engagement cylinder
49. a flat engagement cylinder end face
50. an engagement bearing inner ring
51. an engagement bearing outer rim
52. a V-shaped end of the engagement cylinder
53. a linear engagement cylinder flange
54. a linear groove in the engagement cylinder hole wall
55. an engagement cylinder lock pin
56. a cylindrical lock-pin hole in the flywheel
57. cylindrical lock-pin holes in the engagement cylinder
58. a threaded end of the lock-pin
59. a threaded end section of the cylindrical lock-pin hole
60. a square nut-like section of the center rod near each end
61. a square depression at the center of the interior flat surface of the outer housing end cap
62. a threaded extreme end section of the center rod
63. a round hole in the center of the flat back surface of the outer housing end cap
64. a center rod end nut
65. an outer housing end flange
66. an outer housing end cap groove
67. an interior cylindrical surface of the outer housing end cap
68. one of a pair of guide bearings
69. an inner ring of a guide bearing
70. a face of a guide bearing mounting
71. a guide bearing mounting
72. a side of the guide bearing track
73. an outer rim of a guide bearing
74. a rotatable back plate of the flywheel assembly end cap
75. an end cap outer ring
76. an end cap inner ring
77. a rigid back plate of the flywheel assembly end cap
78. a lip on the end cap inner ring
79. a lip on the end cap outer ring
80. a spring fastener or holder
110. a first alternative embodiment of the rhythmic motion driver, illustrated generally
111. an extended rectangular outer housing -continued

LIST OF DESCRIPTIVE REFERENCE NUMBERS 112. a multiple flywheel assembly
115. a pair of bearings
116. a linear track
117. an attachment bar
122. a slot in the outer housing
123. a flywheel
124. a toothed bar
125. a roller
126. a gear
127. a spring
210. a second alternative embodiment of the rhythmic motion driver, illustrated generally
211. an outer frame
217. an attachment bar
222. a slot in the frame
223. a flywheel
224. a partial toothed wheel
226. a gear
227. a spring

What is claimed is:

1. A method of exercising comprising:

(a) providing a guided, moveable attachment that includes flywheels, mechanically leveraged to produce angular momentum simultaneously with a movement of said attachment, (b) exerting a force on the attachment that causes the guided attachment to move along a guide;

(c) providing sufficient, resilient resistance with a spring to the moving attachment to cause the moving attachment to stop and return along said guide, until the resilient resistance from the spring again stops and reverses the motion of the attachment, producing a rhythmic oscillation of said attachment; and, (d) storing a portion of the force as energy in the spring and flywheels.

2. A method as in claim 1, further comprising:

(a) providing horizontally guided movement of a first attachment mechanically leveraged to produce the simultaneous angular momentum, said horizontally guided movement being resisted by a first resilient force, said first attachment being constituted by the guided moveable attachment, (b) providing from said first attachment a vertically guided movement of a second attachment that is mechanically leveraged to produce simultaneous angular momentum, and said vertically guided movement resisted by a resilient force from a further spring, whereby said second attachment drives a movable element in independent vertical and horizontal rhythmic motions simultaneously.

3. A method as in claim 1, comprising:

(a) providing a first guided movement of a first attachment that is mechanically leveraged to produce simultaneous angular momentum, said first guided movement being resisted by a first resilient force exerted by the spring, the first attachment being constituted by said guided attachment, (b) providing, from said first attachment, a second guided movement of a second attachment that is mechanically leveraged to produce simultaneous angular momentum, said second attachment moving perpendicular to said first guided movement, said second guided movement being resisted by a second resilient force from a further spring, (c) providing, from said second attachment, a third guided movement of a third attachment that is mechanically leveraged to produce simultaneous angular momentum, said third guided movement being perpendicular to both said first and said second guided movements, said third guided movement being resisted by a third resilient force from an additional spring, whereby said third attachment drives a movable element in three rhythmic motions that are perpendicular to each other, resulting in a periodic path through three dimensions.

4. A method of exercising comprising:

(a) providing an apparatus having an attachment that is moveable in an oscillatory motion, a rotatable flywheel rotatable relative to the attachment, a spring displaceable between compressed and expanded positions, the spring opposing the rotation of the flywheel wherein the oscillatory motion of the attachment corresponds with the rotation of the flywheel and with the displacement of the spring;

(b) exerting a linear force on the attachment to move the attachment; and, (c) storing a portion of the force as energy.

5. The method of exercising according to claim 4 further comprising:

(d) exerting forces on the attachment to move the attachment in phase with its oscillation, such that a distance traveled by the attachment becomes greater for each oscillation;

(e) discontinuing the exertion of forces on the attachment thus allowing the distance traveled by the attachment to diminish as the stored energy is expended; and, (f) alternating between exerting force and discontinuing the exertion of force on the attachment.

6. A method of exercising comprising:

(a) providing a first apparatus having a first attachment that is moveable in a back and forth oscillatory motion along a first path, a rotatable flywheel, a spring displaceable between compressed and expanded positions, the spring opposing a rotation of the flywheel wherein the back and forth oscillatory motion of the attachment corresponds with a rotation and a counter-rotation of the flywheel and with a displacement of the spring, (b) providing a second apparatus, attached to the first attachment, the second apparatus having a second attachment, wherein as the first attachment moves in an oscillation along the first path, the second attachment simultaneously moves in the oscillation along the first path and in an oscillation along a second, perpendicular, path; and, (c) moving the second attachment simultaneously along the lines of oscillatory motion of both the first attachment and the second attachment.

7. The method according to claim 6 further comprising:

(d) providing an element connected to the second attachment;

(e) wherein moving said second attachment is accomplished by moving the element;

(f) exerting forces on the element in phase with an oscillatory movement of the element, (g) storing a portion of the forces as energy;

(h) wherein a distance traversed by the element become gradually longer as more energy is stored;

(i) discontinuing the exertion of forces on the element thus allowing the distance traveled by the element to diminish as the stored energy is expended; and, (j) alternating between exerting force and discontinuing the exertion of force on the element.

8. The method according to claim 7 further comprising;

(k) exerting a smaller relative amount of force, in phase with the oscillations of the element along the first path than along the second path, wherein a combined path of oscillation of the element forms an ellipse whose long axis is in the direction of the second path and whose short axis is in the direction of the first path.

9. The method according to claim 8 further comprising:

(l) altering the exertion of force to exert a smaller relative amount of force, in phase with the oscillations of the element along the second path than along the first path, wherein the path of oscillation of the pedal forms an ellipse whose long axis is in the direction of the first path and whose short axis is in the direction of the second path.

10. The method according to claim 8 further comprising:

(l) altering the exertions of force to change the shape of the combined path of oscillation of the element.

11. The method according to claim 10 wherein the shape of the combined path is altered to be a circle.

12. The method according to claim 10 wherein the shape of the combined path is altered to be a figure eight.

13. The method according to claim 7 further comprising:

(k) providing a third apparatus, attached to the second attachment, the third apparatus having a third attachment, wherein as the first attachment moves in an oscillation along the first path, and the second attachment simultaneously moves in an oscillation along the first path and along a second, perpendicular path, the third attachment simultaneously moves in an oscillation along the first path, the second path and a third path, perpendicular to both the first and second paths;

(l) wherein the element is connected to the third attachment;

(m) simultaneously moving the element along the lines of oscillatory motion of the fist attachment, the second attachment and the third attachment.

14. The method according to claim 3 further comprising:

(g) exerting forces in phase with an oscillatory movement of the element, (h) storing a portion of the forces as energy;

(i) wherein a distance traversed by the element become gradually longer as more energy is stored;

(j) discontinuing the exertion of forces on the element thus allowing the distance traveled by the element to diminish as the stored energy is expended; and, (k) alternating between exerting force and discontinuing the exertion of force on the element.

15. The method according to claim 13 further comprising:

(g) exerting a smaller relative amount of force, in phase with the oscillations of the element, along the first path than along the second path and third path.

16. The method according to claim 15 further comprising:

(h) altering the exertion of force to exert a smaller relative amount of force, in phase with the oscillations of the element, along the second path than along the first and third paths.

17. The method according to claim 15 further comprising:

(i) altering the exertion of force to exert a smaller relative amount of force, in phase with the oscillations of the element, along the third path than along the first and second paths.

* * * * *